United States Patent [19]

Niepmann

[11] 3,944,066

[45] Mar. 16, 1976

[54] CUT FOR A BOX FOR CIGARETTES AND CIGARILLOS AND BOX MADE THEREFROM

[75] Inventor: Otto Niepmann, Gevelsberg, Germany

[73] Assignee: Maschinenfabrik Fr. Niepmann & Co., Gevelsberg, Germany

[22] Filed: Dec. 16, 1974

[21] Appl. No.: 533,241

[30] Foreign Application Priority Data

Dec. 15, 1973 Germany ..... 2362427

[52] U.S. Cl. ..... 206/268; 229/44 CB; 229/51 C; 206/273

[51] Int. Cl.[2] ..... B65D 5/66

[58] Field of Search ..... 206/245, 271, 273, 268, 206/265; 229/51 C, 87 C, 44 CB, 44 R

[56] References Cited

UNITED STATES PATENTS

| | | | |
|---|---|---|---|
| 2,247,870 | 7/1941 | Chalmers | 229/44 R |
| 2,954,867 | 10/1960 | Tacke | 229/44 CB |
| 3,858,788 | 1/1975 | Phillips, Jr. | 206/268 |

FOREIGN PATENTS OR APPLICATIONS

| | | | |
|---|---|---|---|
| 561,173 | 4/1957 | Italy | 229/44 CB |
| 1,161,513 | 1/1964 | Germany | 229/44 CB |

*Primary Examiner*—William Price
*Assistant Examiner*—Douglas B. Farrow
*Attorney, Agent, or Firm*—Walter Becker

[57] ABSTRACT

A cut of paper material such as stiff paper or thin card board for a box for cigarettes and cigarillos and a box made therefrom, according to which within the region of the folding line between the front wall section and the side wall sections pertaining thereto on one hand and the set-back lines along which the upper portion of the front wall section and of the pertaining side wall sections are set back toward the interior of the box to be formed on the other hand a slot is provided at each corner formed by the intersecting set-back lines and the folding lines of the side wall sections.

5 Claims, 2 Drawing Figures

CUT FOR A BOX FOR CIGARETTES AND CIGARILLOS AND BOX MADE THEREFROM

The present invention relates to a cut for a box of stiff paper, cardboard, or the like, which is intended for cigarettes and cigarillos, and which has a rectangular bottom with adjacent longitudinal sides and adjacent thereto on both sides longitudinal balls for forming double-walled narrow sides. These narrow sides are connected to the bottom by base flaps. The said box is furthermore provided with a cover at the rear side wall which cover has a cover bottom, a cover rear wall, a cover front wall, and cover side walls interconnected through cover flaps. The cover front wall is longer than the cover rear wall and cooperates with a box neck acting as guiding and braking means for the cover. The box neck comprises two lateral parts and a front part, which parts when the cover is closed extend up to the cover bottom, and of which the front part is provided with a cutout. The front and side parts forming the cover neck form one piece with the side wall and longitudinal walls and are by grooving offset inwardly by the thickness of the material.

A cut of the above mentioned type is known and has the drawback that during the grooving or marking, dislocations of the material within the region of the marking edge occur which affect the appearance of the marking edge, bring about a poor fit of the cover in its closed position, and require a high marking or stamping force.

Starting with the heretofore known cut, it is an object of the present invention to overcome the above outlined drawbacks of heretofore known cuts and boxes of the type involved and which, while only relatively low forces are employed during the grooving or marking will have a proper appearance and will yield a good fit of the cover in its closing position.

These and other objects and advantages of the invention will appear more clearly from the following specification, in connection with the accompanying drawings, in which.

The cut according to the present invention is characterized primarily in that within the region of the grooving edge between the front side wall and the longitudinal walls on one hand, and the front part and the side parts of the box neck on the other hand, a slot is provided on each corner formed by the longitudinally extending folding line.

According to a further development of the invention, the slots are designed in the manner of a T with three legs, of which two extend along the grooving edge whereas the third extends along the folding line of the box neck. According to a preferred embodiment of the invention, the legs of the slot have a length of from 2 to 8 mm.

The slots according to the invention yield a number of advantages over the heretofore known cut. On one hand, the material to be grooved is within the region of the critical corners made "soft" so that the grooving for purposes of the offset of the box neck by the thickness of the material toward the inside can be carried out with reduced grooving force. On the other hand, the groove makes it possible that the material can escape during the grooving operation so that a proper course of the grooving edge will also be obtained within the region of the corners. In view of the legs of the two triangular slots which legs rest on the folding line of the box neck, braking surfaces are created on the box neck so that without the heretofore known braking cuts which have additionally to be provided, a good hold of the cover or lid in its closed position of the box will be realized.

Finally, when the lid is closed, the corners of the box neck, which corners are provided with the slot, can escape inwardly, whereby a good fit of the lid will be obtained when the box is closed. Inasmuch as the two triangular slots per box cut can simultaneously, or shortly prior to the grooving, be provided by one and the same tool, the design of the cut does not require any additional working operation, but only a slight change in the tool for making the cut.

Figure 1:
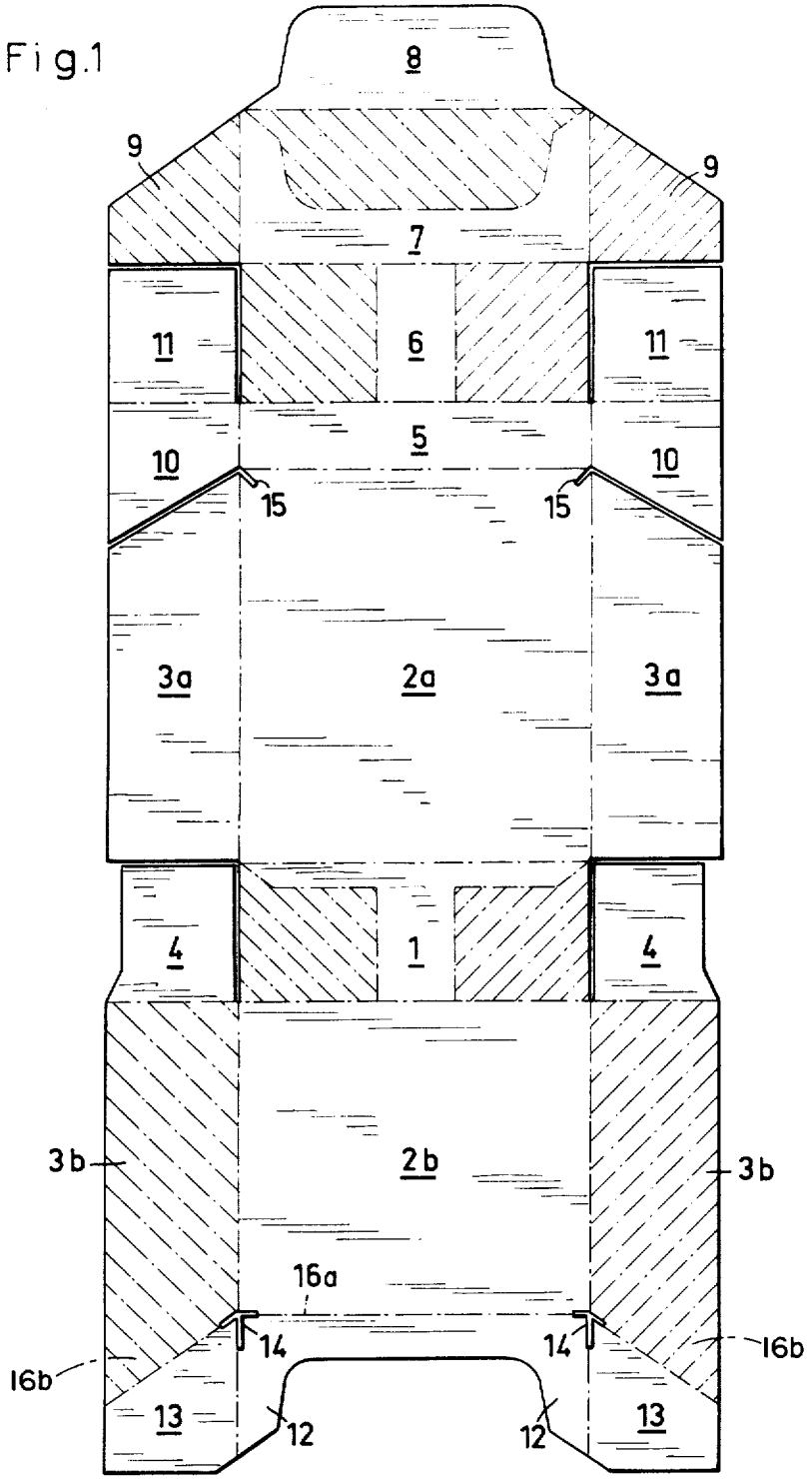
FIG. 1 represents a top view of the cut according to the invention.

Referring now to the drawings in detail, the cut illustrated in FIG. 1 has a bottom 1 of a rectangular shape, the longitudinal sides of which, have arranged adjacent thereto a likewise rectangular side walls 2*a*, 2*b*, respectively. Arranged on both longitudinal sides of the side walls 2*a*, 2*b*, are longitudinal walls 3*a* and 3*b*, respectively. After the box has been folded, the longitudinal walls 3*a* and 3*b* form double layer narrow sides, said longitudinal walls 3*b* forming the outer position. According to the illustrated embodiment, the longitudinal walls 3*b* are provided with base flaps 4 which are connected to the inside of the bottom 1 as is indicated by dot-dash lines.

On the side wall 2*a* there is provided a rear wall 5 of the lid which lid furthermore comprises a lid bottom 6, a lid front wall 7 and lid side walls 9. The lid front wall 7 is provided with a reinforcement 8 forming a flap on the lid front wall 7. The connection of the lid parts to each other is effected by gluing the lid side walls 9 to the lid flaps 10 which are arranged on the cover rear wall 5. In order to obtain an additional reinforcement of the cover, rectangular reinforcement flaps 11 are formed onto the cover flaps 10. The reinforcement flaps 11 are glued to the surface of the lid bottom 6 as indicated by dot-dash lines.

The above described parts form the lower portion and the lid of the box which is additionally provided with a box neck. The box neck is offset inwardly by the thickness of the material of the cut. To this end, a front portion 12 of the box neck is formed onto the side wall 2*b*. This front portion 12 comprises two side parts 13 respectively formed onto a longitudinal wall 3*b*. The parts 12 and 13 of the box neck are offset along a groove edge 16 toward the interior by the thickness of the material as is clearly evident from FIG. 2.

After the box has been folded and formed, the box neck composed of the front portion 12 and side parts 13 forms a guiding means and brake for the lid. In order to increase the flexibility of the bending edge forming the hinge between the side wall 2*a* and the lid rear wall 5, slots 15 are provided, as clearly shown in FIG. 1.

At the two corners of the grooving edge 16*a* which extends between the front side wall 2*b* and the longitudinal walls 3*b* on one hand, and the front part 12 and side parts 13 of the box neck on the other hand, there is provided a triangular slot 14. Two of the legs of the slot 14 are located on the grooving edge edges 16*a* and 16*b*. The third leg of the slot 14 extends along the folding line of the box neck and, more specifically, between the front part 12 of the box neck and the respective side part 13. The position of the triangular grooves 14 is clearly evident from FIGS. 1 and 2.

In addition to softening the material for the cut at the two corners, which softening will permit a reduction in the grooving force and also an escape of the material during the grooving operation so that a proper course of the grooving edge 16 will be obtained within the region of the corners, the triangular slots 14 also bring about the formation of braking surfaces for the lid and the possibility of the corners escaping inwardly when the lid is closed. In this way a holding fast of the lid and a good fit of the lid in its closed position will be assured.

Figure 2:
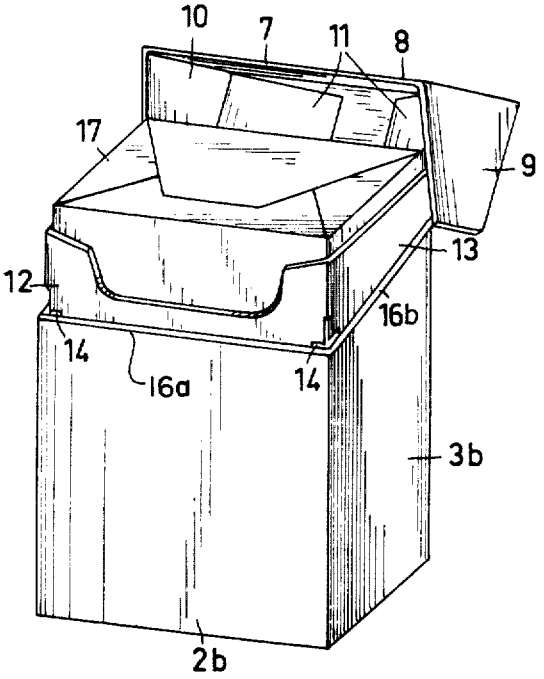
FIG. 2 is an isometric view of a box which has been prepared from the cut of FIG. 1 and which is shown with the lid in open position.

From the perspective illustration according to FIG. 2, it will also be seen that the lid, in view of the inwardly offset neck portion, forms with the lower part of the box a smooth-walled parallelepiped which on all sides encloses the block 17 of cigarettes enveloped in aluminum foil. The foldability of the lid permits the simple withdrawals of cigarettes and a sufficiently tight closure of the broken package.

It is, of course, to be understood that the present invention is, by no means, limited to the specific showing in the drawings, but also comprises any modifications within the scope of the appended claims.

What I claim is:

1. A cut of paper material having applied thereto only nominal force during stamping thereof to provide a satisfactory appearance of the stamping edge as well as a good seating of the cover in the closure position for a box for cigarettes and cigarillos which cut is longer than it is wide and has an inside surface and an outside surface, and which includes in combination: a rectangular bottom section, a front wall section, a rear wall section, said front and rear wall sections respectively being arranged at and along the oppositely located longitudinal sides of said rectangular bottom section, two pairs of side wall sections, the two side wall sections of one of said pairs of side wall sections being respectively connected to and forming a single integral piece with those opposite sides of said front wall section which extend in the longitudinal direction of said cut, each pair of said one side wall sections being foldable in the direction toward the inside surface of said front wall section so as to form a right angle therewith, and the two side wall sections of the other one of said pairs of side wall sections being respectively connected to and forming a single integral piece with those opposite sides of said rear wall section which extend in the longitudinal direction of said cut, each side wall section of said other pair of side wall sections foldable in the direction toward the inside surface of said rear wall section so as to form a right angle therewith, the side wall sections of one of said pairs of side wall sections having extension flaps arranged adjacent said bottom section and foldable thereonto, said front wall section being provided at its free edge with a cut-out and having a portion near said cut out offset along an offsetting line toward the inside surface of said front wall section by a distance approximating the thickness of said cut, said offsetting line extending over the width of said front wall section, the adjacent portions of said pair of side wall sections pertaining to said front wall section being likewise offset toward the inside surface of said cut by the thickness of the latter along offsetting lines respectively inclined from each end of the offsetting line of said front wall section toward the respective adjacent oppositely located edge of said last mentioned side wall sections, the areas where said offsetting line of said front wall section meets with the offsetting lines of the side wall sections pertaining to said front wall section and with the folding lines of said last mentioned side wall sections being provided with slot means, that end portion of said rear wall section which is remote from said bottom section including a strip extending throughout the width of said rear wall section and being foldable toward the outside surface of said rear wall section, the side wall sections pertaining to said rear wall section being each provided with a slot extending from the ends of said folding line to said strip at an angle slightly into said rear wall section and also through the respective one of each of said last mentioned side walls along the width thereof and in a direction at an acute angle relative to the folding lines of the respective side wall sections pertaining to said rear wall section, and a lid connected to and forming one single piece with said strip, said lid including a top section alongside said strip and also a front part alongside said top section and side portions foldable in the direction toward the inner surface of said front part and having an inclined free edge with an angle of inclination corresponding to that of said offsetting lines of the side wall sections pertaining to said front wall section, one end of said side wall sections pertaining to said rear wall section having an extension foldable along a line forming an extension of the folding line along which said strip is united to said rear wall section, said one end of each of said last mentioned side wall sections being foldable onto said top part of said lid, each of said slot means extending at least along a portion of the respective offsetting line of that end portion of said front wall section which is provided with said cut-out and along a portion of the folding lines of the side wall sections adjacent thereto in the direction toward the adjacent end of said cut.

2. A cut of paper material for a box for cigarettes and cigarillos which cut is longer than it is wide and has an inside surface and an outside surface, and which includes: a rectangular bottom section, a front wall section, a rear wall section, said front and rear wall sections respectively being arranged at and along the oppositely located longitudinal sides of said rectangular bottom section, two pairs of side wall sections, the two side wall sections of one of said pairs of side wall sections being respectively connected to and forming a single integral piece with those opposite sides of said front wall section which extend in the longitudinal direction of said cut, each pair of said one side wall sections being foldable in the direction toward the inside surface of said front wall section so as to form a right angle therewith, and the two side wall sections of the other one of said pairs of side wall sections being respectively connected to and forming a single integral piece with those opposite sides of said rear wall section which extend in the longitudinal direction of said cut, each side wall section of said other pair of side wall sections being foldable in the direction toward the inside surface of said rear wall section so as to form a right angle therewith, the side wall sections of one of said pairs of side wall sections having extension flaps arranged adjacent said bottom section and foldable thereonto, said front wall section being provided at its free edge with a cut-out and having a portion near said cut-out offset along an offsetting line toward the inside surface of said front wall section by a distance approximating the thickness of said cut, said offsetting line extending over the width of said front wall section, the adjacent portions of said pair of side wall sections pertaining to said front wall section being likewise offset toward the inside surface of said cut by the thickness of the latter along offsetting line respectively inclined from each end of the offsetting line of said front wall section toward the respective adjacent oppositely located edge of said last mentioned side wall sections, the areas where said offsetting line of said front wall section meets with the offsetting lines of the side wall sections pertaining to said front wall section and with the folding lines of said last mentioned side wall sections being provided with slot means, that end portion of said rear wall section which is remote from said bottom section including a strip extending throughout the width of said rear wall section and being foldable toward the outside surface of said rear wall section, the side wall sections pertaining to said rear wall section being each provided with a slot extending from the ends of said folding line to said strip at an angle slightly into said rear wall section and also through the respective one of each of said last mentioned side walls along the width thereof and in a direction at an acute angle relative to the folding lines of the respective side wall sections pertaining to said rear wall section, and a lid connected to and forming one single piece with said strip, said lid including a top section alongside said strip and also a front part alongside said top section and side portions foldable in the direction toward the inner surface of said front part and having an inclined free edge with an angle of inclination corresponding to that of said offsetting lines of the side wall sections pertaining to said front wall section, one end of said side wall sections pertaining to said rear wall section having an extension foldable along a line forming an extension of the folding line along which said strip is united to said rear wall section, said one end of each of said last mentioned side wall sections being foldable onto said top part of said lid, each of said slot means forming a T-shaped slot extending along a portion of the respective offsetting line of that end portion of said front wall section which is provided with said cut-out and along a portion of the folding lines of the side wall sections adjacent thereto in the direction toward the adjacent end of said cut, said T-shaped slot also extending along the offsetting inclined lines of said last mentioned side wall sections.

3. A cut according to claim 2, in which the length of each arm of said T-shaped slots amounts to from 2 to 8 mm.

4. A cut according to claim 2, which includes a lid reenforcement formed by a flap forming one piece with the front part of said lid and being foldable onto the inner side of said front part.

5. A box for cigarettes and cigarillos which is made of a single piece of stiff paper material and which includes: a receiving section having a rectangular bottom and a rectangular front wall section with a cut-out at the upper portion of the latter and also having a rear wall section and side wall sections interconnecting said front and rear wall sections, said front wall section and said side wall sections having their upper ends offset toward the interior of said receiving section by a distance substantially equalling the thickness of said front and side wall sections, said box also being provided with slot portions located where the front wall section joins the side wall sections pertaining thereto and where said upper portion of said front wall section and the upper portion of said last mentioned side wall sections have been offset toward the interior of said box.

* * * * *